US005282330A

United States Patent [19]

Hannula

[11] Patent Number: 5,282,330

[45] **Date of Patent: * Feb. 1, 1994**

[54] ILLUMINATED SIGN WITH ICE-LIKE CHARACTERS

[75] Inventor: Paul Hannula, Minneapolis, Minn.

[73] Assignee: Lakeside Ltd., Minneapolis, Minn.

[ * ] Notice: The portion of the term of this patent subsequent to Mar. 31, 2009 has been disclaimed.

[21] Appl. No.: 783,108

[22] Filed: Oct. 25, 1991

Related U.S. Application Data

[63] Continuation of Ser. No. 430,735, Nov. 2, 1989, Pat. No. 5,099,593.

[51] Int. Cl.[5] ..... G09F 13/04

[52] U.S. Cl. ..... 40/552; 40/564

[58] Field of Search ..... 40/205, 428, 541, 552, 40/564, 580, 619; 362/97

[56] References Cited

U.S. PATENT DOCUMENTS

| | | | |
|---|---|---|---|
| Re. 20,104 | 9/1936 | Stonebraker, Sr. . | |
| 276,558 | 5/1883 | Brown, Jr. | 40/580 |
| 498,430 | 5/1893 | Gregory | 40/619 |
| 859,199 | 7/1907 | Chinnery | 40/580 X |
| 1,176,746 | 3/1916 | Federico . | |
| 1,202,593 | 10/1916 | Scott . | |
| 1,397,995 | 11/1921 | Wade . | |
| 1,407,345 | 2/1922 | Wirsching et al. | 40/619 |
| 1,600,243 | 9/1926 | Passmore | 40/564 |
| 1,649,708 | 11/1927 | Large et al. . | |
| 1,795,004 | 3/1931 | Archer | 40/428 |
| 1,839,165 | 12/1931 | Roseby | 40/428 X |
| 2,276,856 | 3/1942 | Mulberger . | |
| 2,293,106 | 8/1942 | Bourdakoff . | |
| 2,335,951 | 12/1943 | Mansell . | |
| 2,608,013 | 8/1952 | Marsala . | |
| 3,137,083 | 6/1964 | George et al. | 40/205 X |
| 3,957,351 | 5/1976 | Stockwell | 350/160 |
| 4,138,620 | 2/1979 | Dickson | 313/1 |
| 4,418,378 | 11/1983 | Johnson | 362/97 |

*Primary Examiner*—Kenneth J. Dorner
*Assistant Examiner*—J. Bonifanti
*Attorney, Agent, or Firm*—Kenyon & Kenyon

[57] ABSTRACT

A simple, yet well-constructed illuminated sign has characters appearing as glistening ice chunks. The illuminated sign includes a light source which is surrounded by a diffusion member. This illuminated sign also includes a reflecting member disposed on one side of the light source and a diffusion panel disposed on the other side of the light source. This illuminated sign further includes a generally opaque sign panel with raised transparent characters having a chiseled ice-like configuration whereby the light from the light source, following multiple diffusion and reflection, passes through the raised transparent characters to form a lighted sign with characters which appear as if they were chiseled from blocks of ice.

12 Claims, 2 Drawing Sheets

ILLUMINATED SIGN WITH ICE-LIKE CHARACTERS

This application is a continuation of application Ser. No. 07/430,735, filed Nov. 2, 1989, now U.S. Pat. No. 5,099,593.

The present invention relates to the field of illuminated signs, and more particularly to a novel illuminated sign which portrays characters in the shape of glistening ice chunks.

BACKGROUND OF THE INVENTION

Illuminated signs, in one form or another, have been developed along with the candle, light bulb, and fluorescent lamp. The first illuminated sign probably consisted of a covered candle whose light would shine through an opening in the cover. With the advent of electricity and the light bulb, illuminated signs became more prevalent. A majority of these signs would include a light bulb as the light source, a cover which would have certain shapes cut into it in order to allow the light from the light bulb to shine through, and a reflector in order to reflect the light produced by the light bulb more directly through the spaces cut in the cover.

As illuminated signs became more common, a number of variations were designed. For example, the light emanating from a light source would sometimes be diffused in order to provide a certain effect or a certain color to the light emerging from the openings in a cover. Of course, with the advent of the fluorescent lamp and the neon lamp, illuminated signs became even more fanciful.

Nevertheless, as illuminated signs became more plentiful their ability to attract attention, for which they were originally designed, became less pronounced. The proliferation of illuminated signs has made them a victim of their own success. An illuminated sign no longer attracts the attention of a bypasser as it once did. Furthermore, some of the newer signs which rely on gimmicks to attract attention have become complicated and expensive to install and maintain.

This is particularly true in the beer and soft drink field where various types of animated signs have long competed for the consumer's jaded attention, and where there is a constant demand for signs having new and different effects, particularly effects that increase the consumer's desire to purchase the beverages advertised.

As a result, sign makers have experimented with various types of illuminated signs designed to suggest the cool and refreshing aspects of cold beverages, including signs portraying animated water falls, sparkling lakes and rivers, and snowy and winter ice-type scenes. While some of these signs have been effective, there is a limit to the realism of previous signs seeking to convey images of ice and snow to suggest cold and refreshing beverages. Consequently, there has been a demand by beverage suppliers and distributors for new types of signs with more realistic images of snow and ice both to capture the consumer's attention and to stimulate his desire to purchase the cold beverages being advertised.

In response to this demand, applicant has sought to develop illuminated signs with letters having a realistic ice-like appearance. To this end, applicant has experimented with various configurations of light sources, reflectors and diffusion means, as well as vacuum formed sign panels with ice shaped letters. In one prior art version, applicant attempted to interest potential customers in a sign with a light source surrounded by a diffusion member, a reflector, and a vacuum formed sign panel with transparent ice shaped letters, but the sign lacked the realism of the present invention and was not successful. Subsequently, applicant discovered that the addition of a separate diffusion panel in addition to a diffusion member surrounding the light source creates a surprisingly more realistic ice-like effect.

SUMMARY OF THE INVENTION

It is, therefore, an object of this invention to provide a low cost, yet well-constructed illuminated sign.

It is a further object of this invention to provide an illuminated sign which will catch people's attention in a sea of competing signs.

It is another object of this invention to provide an illuminated sign which will be easy to install and inexpensive to run and service.

It is a further object to provide an illuminated sign, useful in advertising and promoting sales of beer and ice-cold beverages, by portraying realistic appearing ice-like characters.

The objects of this invention are accomplished by an illuminated sign whose characters appear like chiseled blocks of ice. The illuminated sign disclosed in this invention includes a light source which is surrounded by a diffusion member. A reflecting member is disposed on one side of the light source while a diffusion panel is disposed on the other side of the light source. The illuminated sign disclosed in this invention further includes a generally opaque sign panel with raised transparent characters which have a chiseled ice-like configuration. The light from the light source passes through the surrounding diffusion member and then passes or is reflected through the diffusion panel and thereafter through the raised transparent characters to form a lighted sign with characters which appear as if they were chiseled from blocks of ice.

DETAILED DESCRIPTION OF PREFERRED EMBODIMENTS

Figure 1:
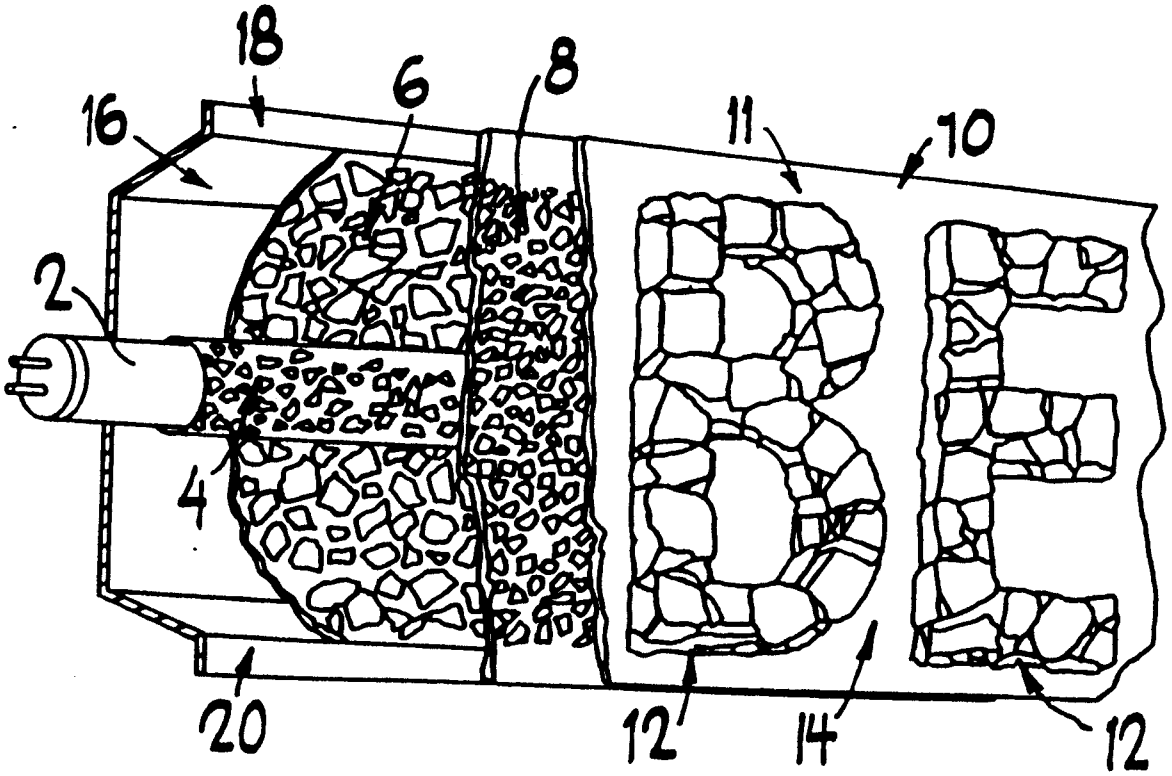
FIG. 1 is a schematic diagram showing one embodiment of an illuminated sign in accordance with the present invention.

Referring specifically to the drawings, FIG. 1 illustrates a preferred embodiment of the present invention. With reference to FIG. 1, a light source 2, in this embodiment an elongated fluorescent lamp, is shown. The light source 2 is surrounded by a diffusion member 4. In this particular embodiment, diffusion member 4 is a clear lamp diffuser with a patterned screen of white and gray which is wrapped around the light source 2. Preferably, the diffusion member is made from a clear polyester or polycarbonate material with the pattern painted in two or three colors by silk screen.

A reflector 6 is disposed on one side of the light source 2 and the surrounding diffusion member 4. In this embodiment, the reflector is of a parabolic shape. Furthermore, the reflector 6 in this embodiment is shown with a rough or dimpled texture. Preferably, the reflector 6 is made from aluminum with a die cut rough surface pattern, and is thereafter formed into a parabolic shape.

A diffusion panel 8 is disposed on the other side of the light source 2 from the reflector 6. In this embodiment, the diffusion panel 8 is of a transparent blue color with a screen pattern thereon. Preferably, the diffusion panel is clear polyester or polycarbonate with a blue silk screen painted pattern.

Further with reference to FIG. 1, a plastic sign panel 10 forming a display portion 11 is shown with raised transparent characters 12 having a chiseled ice-like configuration and surrounded by an opaque area 14. As shown in FIG. 1, each raised transparent character 12 is defined by a plurality of discrete surfaces, each being located in a different plane than at least one other discrete surface and being separated from each other by common boundary lines, wherein the discrete surfaces form a plurality of groups of contiguous discrete surfaces and each group of contiguous discrete surfaces simulates surfaces of a chiseled block of ice and thus forms a character appearing as a chiseled block of ice. In this embodiment the sign panel is preferably made from a suitable clear vacuum formable plastic, such as PETG. The panel is first silk screen painted to cover the opaque portions. Thereafter, the transparent raised portions are vacuum formed. The area 14 surrounding the raised transparent characters is typically black or another dark opaque color to contrast with the ice like letters.

Finally, a housing 16 is formed around the back of the resulting illuminated sign encompassing the light source 2, the surrounding diffusion member 4, and the reflecting member 6. The housing 16 can be opaque plastic or metal and is attached to the diffusion panel 8 and the sign panel 10 at the edges 18 and 20 of the housing 16. Preferably, the housing is a medium impact injection molded polystyrene. The housing 16 also includes end covers, not shown, which enclose the housing's side ends. The light source 2 is wired for electricity with a conventional activating switch (not shown). Such wiring of light fixtures is, of course, well-known in the art.

Figure 2:
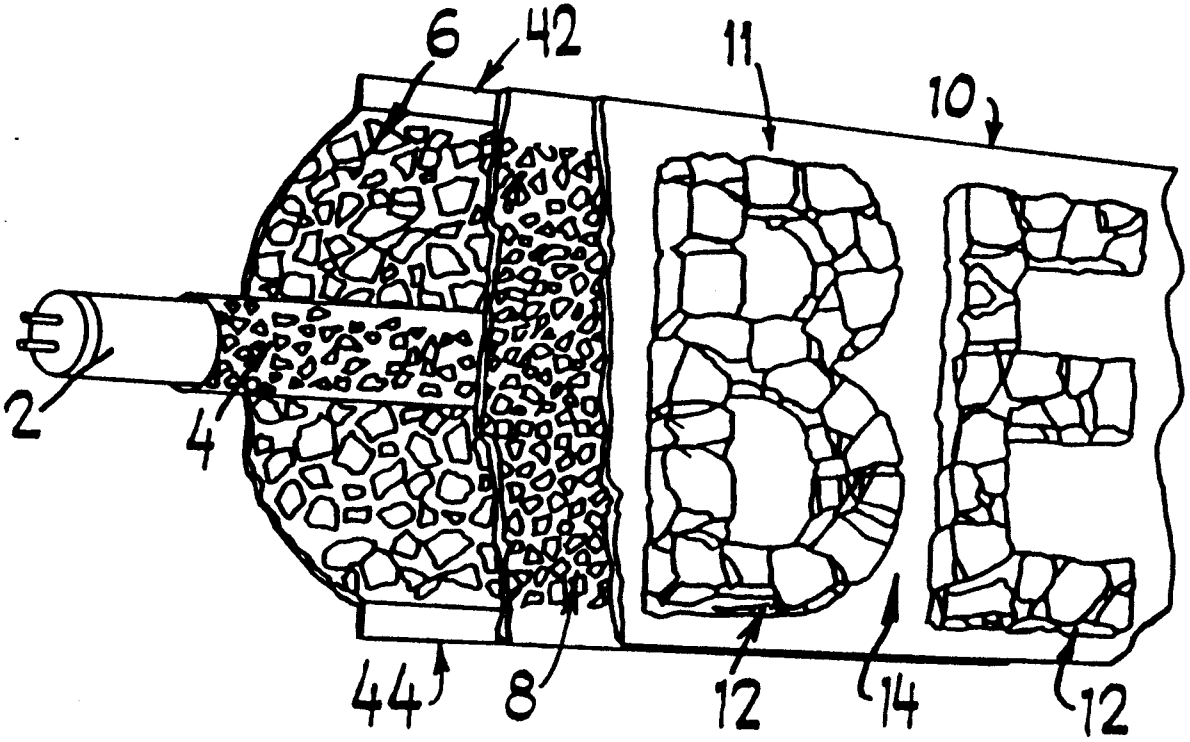
FIG. 2 is a schematic diagram showing another embodiment of an illuminated sign in accordance with the present invention.

Another embodiment of the present invention is shown in FIG. 2. This embodiment differs from the first embodiment only in that the reflecting member 6 also forms the housing 40 for this illuminated sign assembly. The edges 42 and 44 of the reflecting member 6 attach to the diffusion panel 8 and sign panel 10. The ends of the assembly are also enclosed as in the previous embodiment. In other respects, the illuminated sign as shown in FIG. 2 is the same as that shown in FIG. 1.

A number of variations are possible in the construction of this invention as shown in FIGS. 1 and 2. For example, the diffusion member 4 and the diffusion panel 8 can be formed in different colors and with different textures and patterns. These elements can also be made of other suitable plastic materials and can employ vacuum formed patterns for diffusion. Furthermore, the light source 2 can be comprised of various shapes and types of light emitting sources depending on the specific needs of the user. Furthermore, the reflector 6 need not be aluminum, but can be a metallized vacuum formed plastic.

When the illuminated sign disclosed in this invention is activated, light emitting from light source 2 is first diffused by diffusion member 4. Some of the first diffused light proceeds directly through diffusion panel 8 while some of the light is reflected by reflecting member 6 and then proceeds through diffusion panel 8. After the light passes through diffusion panel 8, it strikes the generally opaque sign panel 10 where it encounters the raised transparent characters 12 surrounded by an opaque area 14. The internal diffusion apparatus consisting of diffusion member 4 and diffusion panel 8 causes a multiple diffusion of the originating light. This, in turn, causes the eye to see a remarkably even spread of light over the entire surface of raised letters 12 without noticing the lamp 2 which would otherwise be visible through the raised letters 12. The raised letters 12 have a chiseled, ice-like configuration imparted during vacuum forming, which, when combined with the multiple diffusion means of the present invention, create a surprisingly realistic ice like appearance.

In the foregoing specification, the invention has been described with reference to specific exemplary embodiments thereof. It will be evident, however, that various modifications and changes may be made thereunto without departing from the broad spirit and scope of the invention as set forth in the appended claims. The specification and drawings are accordingly to be regarded in an illustrative rather than in a restrictive sense.

What is claimed is:

1. An illuminated display including features appearing like chiseled blocks of ice, comprising:

a light source;

a first diffusion member located on at least one side of the light source to diffuse the light passing therethrough;

a second diffusion member located on the other side of the first diffusion member with respect to the light source to diffuse the light passing therethrough;

a display portion located on the other side of the second diffusion member with respect to the light source, and including raised transparent features having a chiseled ice-like configuration, each raised transparent feature being defined by a plurality of raised discrete surfaces, each discrete surface being oriented in a different plane relative to at least one other discrete surface, the discrete surfaces forming a plurality of groups of contiguous discrete surfaces, each of the groups of contiguous discrete surfaces simulating surfaces of a chiseled block of ice and forming raised transparent features appearing as a chiseled block of ice, wherein the light from the light source passes through the first diffusion member, and thereafter through the second diffusion member, and thereafter trough the raised transparent features to from an illuminated display with features which appear as if they were chiseled from blocks of ice.

2. An illuminated display as defined in claim 1, wherein the first diffusion member is made from a silk screen painted, clear plastic material.

3. An illuminated display as defined in claim 1, wherein the display portion is made from a vacuum formed plastic material.

4. An illuminated display as defined in claim 1, wherein the first diffusion member has a blue screen pattern.

5. An illuminated display as defined in claim 1, wherein the light source includes at least one fluorescent lamp.

6. An illuminated display as defined in claim 1, wherein the first and second diffusion members are each made from a material selected from the group including a polyester material and a polycarbonate material.

7. An illuminated display with features appearing like chiseled blocks of ice, comprising:

a light source;

first means for diffusing light from the light source located adjacent to the light source;

a display portion located on the other side of the first means for diffusing with respect to the light source, and including raised transparent features having a chiseled ice-like configuration, each raised transparent feature being defined by a plurality of raised discrete surfaces, each discrete surface being oriented in a different plane relative to at least one other discrete surface, the discrete surfaces forming a plurality of groups of contiguous discrete surfaces, each of the groups of contiguous discrete surfaces simulating surfaces of a chiseled block of ice and forming raised transparent features appearing as a chiseled block of ice; and second means for diffusing light from the light source located between the display portion and the first means for diffusing light, wherein the light from the light source passes through the first means for diffusing light, and thereafter through the second means for diffusing light, and thereafter through the raised transparent features of the display portion forming an illuminated display with features appearing as if they were chiseled from blocks of ice.

8. An illuminated display as defined in claim 7, wherein the first and second means for diffusing light each includes a diffusion member made from a material selected from the group including a polyester material and a polycarbonate material.

9. An illuminated display as defined in claim 7, wherein the display portion is made from a vacuum formed plastic material.

10. An illuminated display as defined in claim 7, wherein the first means for diffusing is made from a silk screen painted, clear plastic material.

11. An illuminated display as defined in claim 7, wherein the first means for diffusing includes a blue screen pattern.

12. An illuminated display as defined in claim 7, wherein the light source includes at least one fluorescent lamp.

* * * * *